United States Patent [19]

Patterson

[11] Patent Number: 5,064,002

[45] Date of Patent: Nov. 12, 1991

[54] CONCENTRIC DRILL ROD ASSEMBLIES FOR PERCUSSION ROCK DRILLS

[76] Inventor: William N. Patterson, 7244 S. Garfield, Littleton, Colo. 80122

[21] Appl. No.: 41,704

[22] Filed: Apr. 23, 1987

[51] Int. Cl.[5] ..... E21B 17/00; E21C 3/06

[52] U.S. Cl. ..... 173/80; 173/104; 175/173

[58] Field of Search ..... 173/71, 78, 80, 104, 173/105, 126, 162.1, DIG. 2; 175/173; 279/7, 41 R

[56] References Cited

U.S. PATENT DOCUMENTS

| | | | |
|---|---|---|---|
| 3,011,570 | 12/1961 | Kurt et al. | 173/80 |
| 3,022,769 | 2/1962 | Amundsen et al. | 173/104 |
| 3,136,375 | 6/1964 | Lear et al. | 173/71 |
| 3,926,265 | 12/1975 | Bouyoucos | 173/80 |
| 4,094,364 | 6/1978 | Lundstrom et al. | 173/80 |
| 4,387,775 | 6/1983 | Adolfsson et al. | 173/DIG. 2 X |

*Primary Examiner*—Mark Rosenbaum
*Assistant Examiner*—Scott A. Smith
*Attorney, Agent, or Firm*—Michael E. Martin

[57] ABSTRACT

A percussion drill rod assembly comprising an elongated inner percussion blow transmitting rod of substantially constant diameter supported in a tubular torque transmitting coupling member by spaced apart sets of resilient isolator members secured to the tubular coupling member. The drill rod assembly is connected to a shank assembly at the drill motor and an adaptor assembly at the bit end, each of which include inner percussion blow transmitting members and outer torque transmitting members. Integral drill rod assemblies having inner percussion rods and outer torque transmitting tubular coupling members are adapted for use with feed leg and sinker drills, for example.

3 Claims, 4 Drawing Sheets

CONCENTRIC DRILL ROD ASSEMBLIES FOR PERCUSSION ROCK DRILLS

BACKGROUND OF THE INVENTION

1. Field of the Invention

The present invention pertains to concentric drill rod assemblies for percussion drills having an inner rod member which transmits only percussion blows and an outer tubular sheath which transmits torque from the drill to the bit or a bit adapter member.

2. Background

In the art of percussion drilling several attempts have been made to overcome the deficiencies of the use of end-to-end coupled single rod drill stems which transmit both percussion blows and bit rotation torque from the drill to the bit itself. U.S. Pat. No. 3,011,570 to E. H. Kurt, et al discloses a percussion drill stem assembly wherein an inner rod member transmits only percussion forces from the percussion drill motor to the drill bit or bit adapter and an outer tubular member forms a torque transmitting coupling between the drill motor rotation mechanism and the bit adapter. The Kurt patent discusses several advantages of the concentric drill stem assembly, namely the avoidance of the undue wear and early failure of the threaded couplings and the drill stem members themselves of the single rod type construction. The Kurt reference also describes the advantages of the essentially constant cross-section inner percussion member which minimizes the reflection of percussion forces transmitted from the drill motor to the bit. This reference does not, however, describe any means for isolating the inner rod member from the outer tubular torque transmission member in order to minimize the noise generated by the percussion transmitting member during drilling operations.

U.S. Pat. Nos. 3,981,368 and 4,094,364 to Hans Per Olof Lundstrom, et al also describe a concentric drill rod assembly for percussion drills wherein the inner percussion transmitting rod member is not of constant diameter or constant cross-section, but is provided with radial protrusions for locating or positioning the inner rod member with respect to the outer tubular member. Although the '364 patent to Lundstrom, et al describes a damping layer applied to the outer tubular member and the provision of elastomeric inserts supported by the protrusions on the inner rod member, the system of the Lundstrom, et al patents suffers from the disadvantage of inner rod members which are not of constant diameter or constant cross-section and therefore tend to be inefficient in that they reflect at least part of the compressional force pulses being transmitted by the inner rod member to the bit.

The further development of percussion drill rod assemblies and systems has sought not only to improve the operating life of these mechanisms by providing the concentric inner and outer percussion blow transmitting and torque transmitting members and the advantages that these members provide, but also to provide assemblies which minimize noise transmission from the drill rod assemblies to the operating environment of the drill, and to also improve the construction of these assemblies to minimize the need for special adapters or assemblies at the drill motor and at the percussion bit ends of the drill rod assemblies, respectively. Moreover, there has been a desire to utilize the advantages of the concentric drill rod assemblies in so-called one piece drill stems which are utilized with small handheld feed leg, stoper and similar types of percussion drills. It is to this end that the present invention has been developed with a view to providing improved percussion drill rod assemblies of the concentric inner and outer percussion blow and torque transmitting type as will be further appreciated by those skilled in the art from the further description herein.

SUMMARY OF THE INVENTION

The present invention provides an improved percussion drill rod assembly which provides for efficient force pulse transmission from a drill motor to an impact receiving bit while providing bit rotation torque through an outer tubular member which forms coupling means between the drill motor and the bit. The present invention includes improved means for positioning the inner rod member concentrically with respect to the torque transmitting tube member while minimizing the noise transmitted by the inner rod member to the exterior of the drill rod assembly.

In accordance with an important aspect of the present invention a concentric percussion drill rod assembly is provided having inner rod members of substantially constant diameter and constant cross-section which are arranged for transmitting percussion blows only between an impact transmitting shank member and an impact receiving bit or bit adapter member. The inner rod member is located with respect to an outer tubular torque transmitting coupling member by a series of circumferentially spaced elastomeric isolators which are secured to the outer tube member and snugly journal the inner rod member but permit longitudinal excursion of the inner rod member during compression and extension of the rod member while transmitting percussion blows.

In accordance with another aspect of the present invention there is provided improved percussion blow transmitting and torque transmitting members adapted to be coupled to a drill motor and to an impact receiving bit, respectively, whereby conventional drill motors and impact bits may be utilized with concentric percussion drill rod sections.

In accordance with yet a further important aspect of the present invention, a unique so-called integral or handheld concentric drill stem assembly is provided for applications which do not require extension drill stem members in the form of end-to-end coupled sections for extending the depth of drilling. The improved concentric integral or handheld drill stem assembly includes an inner rod member of constant diameter which is coupled directly to an impact receiving bit and an outer torque transmitting member which is also coupled directly to the bit or may be coupled to the inner rod member in torque transmitting relationship at or directly adjacent to the connection between the inner rod member and the bit.

The unique advantages and superior features of the percussion drill rod assemblies and components of the present invention will be further appreciated by those skilled in the art upon reading the detailed description which follows in conjunction with the drawing.

DESCRIPTION OF THE PREFERRED EMBODIMENTS

Figure 1A:
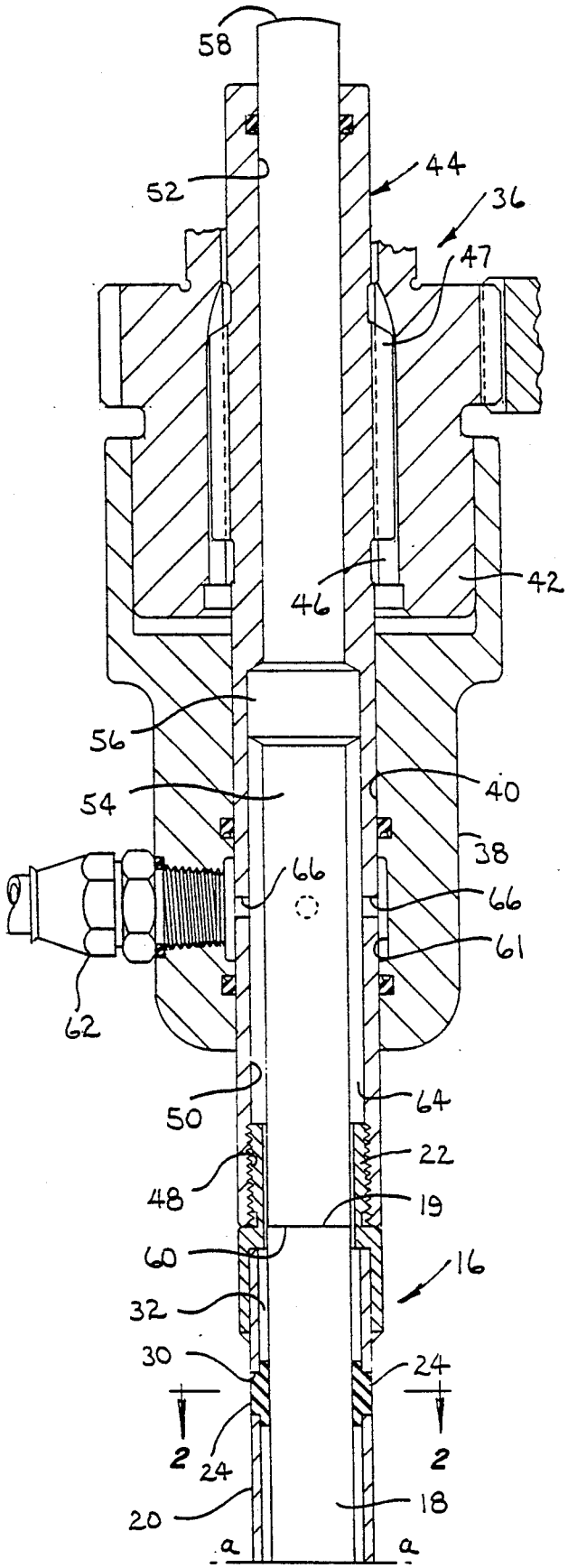
FIGS. 1A and 1B comprise a longitudinal central section view of an improved percussion drill rod assembly in accordance with the present invention.

In the description which follows like parts are marked throughout the specification and drawing with the same reference numerals, respectively. The drawing figures are not necessarily to scale and certain features of the invention may be shown exaggerated in scale in the interest of clarity.

Figure 1B:
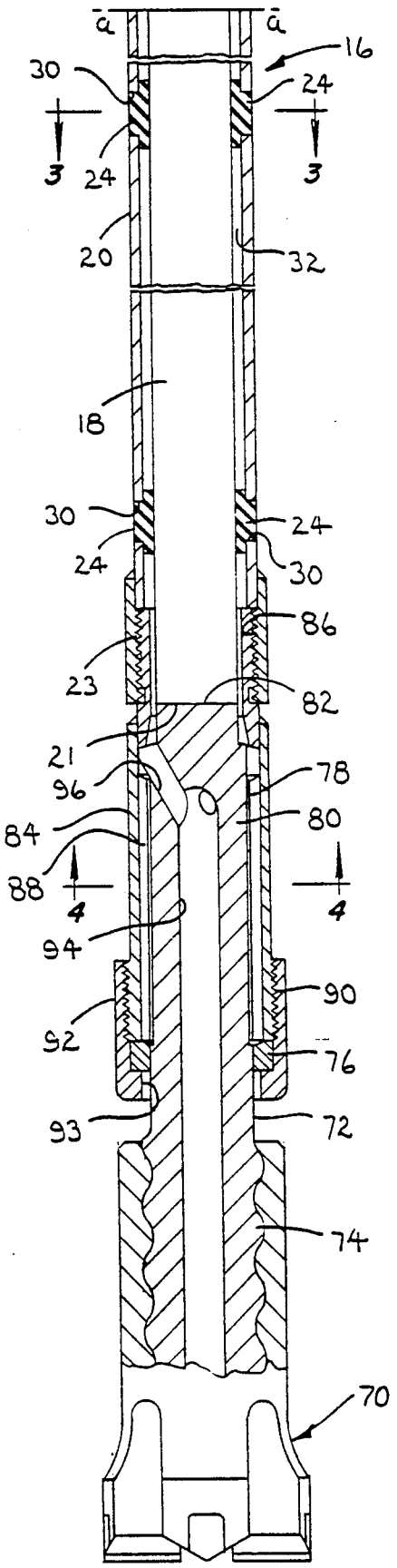

Referring to FIGS. 1A and 1B there is illustrated a percussion drill rod assembly in accordance with the present invention and generally designated by the numeral 16. The drill rod assembly 16 includes one or more elongated substantially cylindrical rod members 18, one shown, which are preferably of constant diameter and are each journaled within an elongated tubular coupling and sheath member 20. The outer coupling member 20 is preferably provided with a coupling portion having external threads 22 at one end and a coupling portion having internal threads 23 at the opposite end whereby plural assemblies of the rod member 18 and tubular coupling member 20 may be coupled end-to-end in a manner similar to other forms of percussion drill rod extension members.

Figure 3:
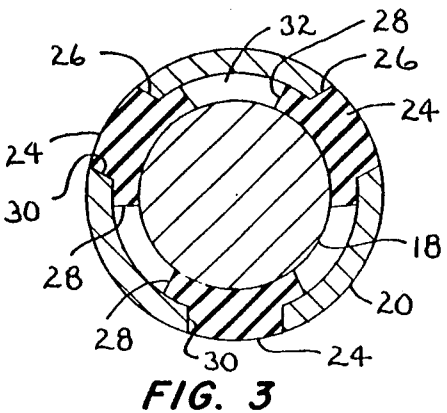
FIG. 3 is a section view taken along the line 3—3 of FIG. 1B.
Figure 2:
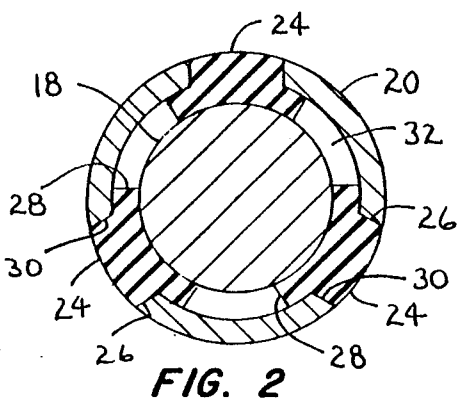
FIG. 2 is a section view taken along the line 2—2 of FIG. 1A

As shown in FIGS. 2 and 3 also, the percussion rod member 18 is journaled within the tubular coupling member 20 by an arrangement of plural elastomeric isolator members 24. The members 24 are each provided as generally circular members having a hub portion 26 and a rod support portion 28 of larger diameter than the hub portion 26. The isolator members 24 are preferably arranged in arrays of three members each equally spaced around the rod member 18 and their respective hub portions disposed in circular openings 30 formed in the tubular coupling members 20. As indicated in FIGS. 2 and 3, the arrangement of the respective arrays of isolator support members 24 is such that they are staggered to give substantially uniform distribution of support for the rod member 18. By way of example the isolator members 24 are formed of castable urethane having a hardness of approximately 40 shore A durometer. The percussion rod member 18 and the outer tubular coupling member 20 may each be formed of alloy steel suitably heat treated in accordance with percussion drill steel manufacturing practices. The percussion drill rod assembly comprising the rod 18 and the tubular coupling member 20 offers all of the advantages described in conjunction with developments of concentric percussion drill steel with the additional benefit of being particularly capable of reduced noise transmission to the environment surrounding the drill rod assembly. Moreover, by providing the percussion rod 18 as a constant diameter member throughout its length, manufacturing processes are simplified and the efficiency of transmitting impact blow energy through the drill rod assembly is substantially improved.

The complete percussion drill rod assembly in accordance with the embodiment illustrated in FIGS. 1A and 1B includes a drill chuck end adapter assembly for use in conjunction with a drill motor, shown in part and designated by the numeral 36. Only the chuck end of the drill motor 36 is illustrated in the interest of clarity and conciseness. The drill motor 36 includes a chuck end cap 38 having a bore 40 formed therein. The cap 38 also at least partially houses a chuck drive member 42 which partially journals a rotary shank assembly 44 and is drivingly connected thereto through suitable interfitting splines 46 and 47. The chuck member 42 is suitably connected to rotary drive means, not shown, for rotating the shank 44. The shank 44 comprises an elongated cylindrical member having suitable internal threads 48 formed at one end and having a stepped bore 50, 52 formed therein for journaling a generally cylindrical percussion blow receiving tappet 54. The tappet 54 includes a collar portion 56 journaled in the bore 50 and is provided with opposed impact surfaces 58 and 60. The impact surface 58 is adapted to receive impact blows from a hammer, not shown, forming part of the drill motor 36. The impact surface 60 is in abutting relationship with a cooperating impact surface 19 formed on the percussion rod 18 for transmitting impact blows from the tappet to the rod 18. The tappet 54 is preferably of constant diameter except for the collar 56 and is also preferably of the same diameter as the drill rod 18 so as to minimize unwanted reflections of the percussive blow energy being transmitted through the drill rod assembly.

As shown in FIG. 1A the end cap 38 is formed with an annular groove 61 in communication with a conduit 62 for connection to a source, not shown, of drill cuttings evacuation fluid such as compressed air, water or a mixture of both. The drill cuttings evacuation fluid is transmitted to an annular space 64 formed between the shank 44 and the tappet 54 for transmission through the space 32 and to a drill bit to be described in detail herein. Radially extending passages 66 are formed in the shank 44 for conducting the fluid between the groove 60 and the space 64.

Referring now to FIG. 1B percussive energy and rotational motion is transmitted to a percussion bit 70 from the drill rod assembly comprising the rod 18 and the tubular coupling member 20 by way of an adapter assembly including a generally cylindrical bit adapter member 72 having suitable coupling threads 74 formed thereon for connection directly to the bit 70 in a conventional manner. The adapter 72 includes a cylindrical collar portion 76 formed thereon and adjacent to elongated splines 78 extending longitudinally along an upper portion 80 of the adapter 72. An impact blow receiving and transmitting surface 82 is formed transversely on the upper portion 80 and is adapted to be in abutting relationship with the transverse end face 21 of the percussion rod 18.

Figure 4:
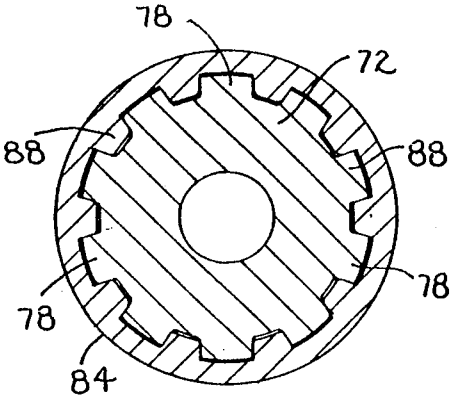
FIG. 4 is a section view taken along the line 4—4 of FIG. 1B.

Rotary motion is transmitted to the adapter member 72 through a tubular coupling member 84 which is threadedly coupled to the tubular coupling member 20 at the threads 23 by cooperating threads 86. As shown in FIG. 4 splines 88 cooperate with the splines 78 to transmit rotary motion to the adapter 72. The coupling member 84 is also provided with external threads 90 which are engaged with a nut 92 threaded over the bit adapter member 72 and is operable to secure the adapter member to the coupling member 84. The nut 92 has a clearance bore 93 formed therein for assembly over the thread 74 of the adapter member. The adapter 72 is provided with elongated passage means 94 and 96 for conducting drill cuttings evacuation fluid to the bit 70 from the passage 32.

In the operation of the drill rod assembly 16 one or more extension rod assemblies comprising a percussion rod 18 and a tubular coupling member 20 may be threadedly coupled end-to-end to make up the requisite length of drill rod assembly and suitably coupled to the shank 54 at one end and the bit adapter assembly comprising the adapter 72 and the coupling 84 at the opposite end. Impact blows may be transmitted through the tappet 54, one or more percussion rods 18 into the adapter 72 with minimal loss of percussive blow energy thanks to the substantially constant diameter configuration of the tappet, the drill rods 18 and the adapter 72. Rotation is imparted to the bit 70 through the shank 44, the tubular coupling member or members 20, and the coupling member 84 to the adapter 72.

Tests conducted with a drill rod assembly of the type illustrated in FIGS. 1A and 1B having an inner rod 18 of approximately one inch outside diameter and a tubular coupling member 20 of 1.25 inches inside diameter and 0.125 inches wall thickness has indicated a reduced noise level over a fairly broad frequency spectrum from about 600 Hz to 8,000 Hz.

Figure 5:
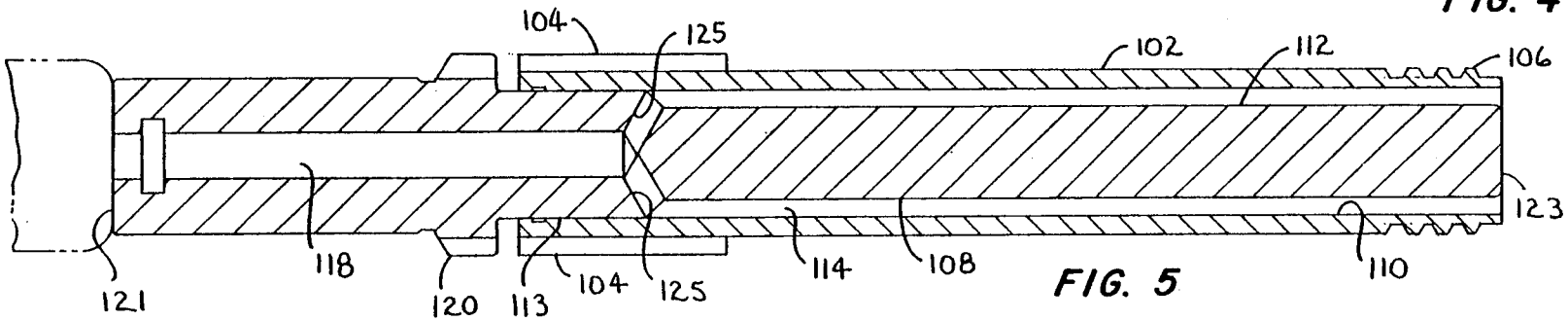
FIG. 5 is a longitudinal section view of an alternate embodiment of a percussion blow transmitting shank and rotation drive tube assembly.

Referring now to FIG. 5, there is illustrated a modification of the tappet and shank assembly for use with drill motors having a flushing air tube extending centrally through the drill and the piston hammer, not shown. The assembly illustrated in FIG. 5 includes a generally tubular shank member 102 having suitable drive flutes or splines 104 formed thereon at one end and suitable coupling threads 106 formed at the opposite end for connection to a drill rod assembly such as an assembly made up of a drill rod 18 and a tubular coupling member 20. An elongated blow transmitting tappet member 108 is journaled by the shank member 102 within a bore 110 formed in the shank member. The tappet 108 includes a reduced diameter impact blow transmitting rod portion 112 and a slightly enlarged portion 114 which is slidably journaled in the bore 110. An annular space 114 is formed between the bore 110 and the tappet portion 112 for transmitting drill cuttings evacuation fluid from a passage 118 which is adapted to receive the aforementioned central cuttings evacuation fluid tube of the drill motor. An annular shoulder 120 is formed on the tappet 108 for retaining the tappet in assembly with the shank 102 during operation when the assembly shown in FIG. 5 is chucked in the end of a conventional drill motor having a central chip evacuation fluid tube. Impact blows are transmitted to an impact receiving surface 121 for transmission through the tappet 108 to a surface 123 which is adapted to be in abutting relationship with a percussive blow transmitting rod such as the rod 18. Rotation is transmitted through the shank 102 from the drill motor drive mechanism, not shown, to the outer tubular coupling member such as the coupling member 20. Chip evacuation fluid is conducted through the passage 18 and radially extending passages 125 into the annular passage 114.

Figure 6:
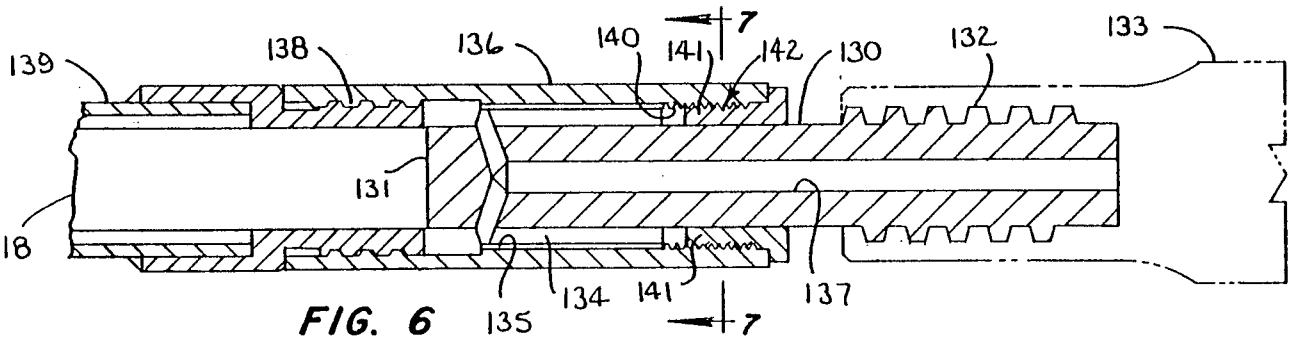
FIG. 6. is a longitudinal central section view of an alternate embodiment of an adapter assembly for transmitting impact blows and rotational torque to a percussion bit.
Figure 8:
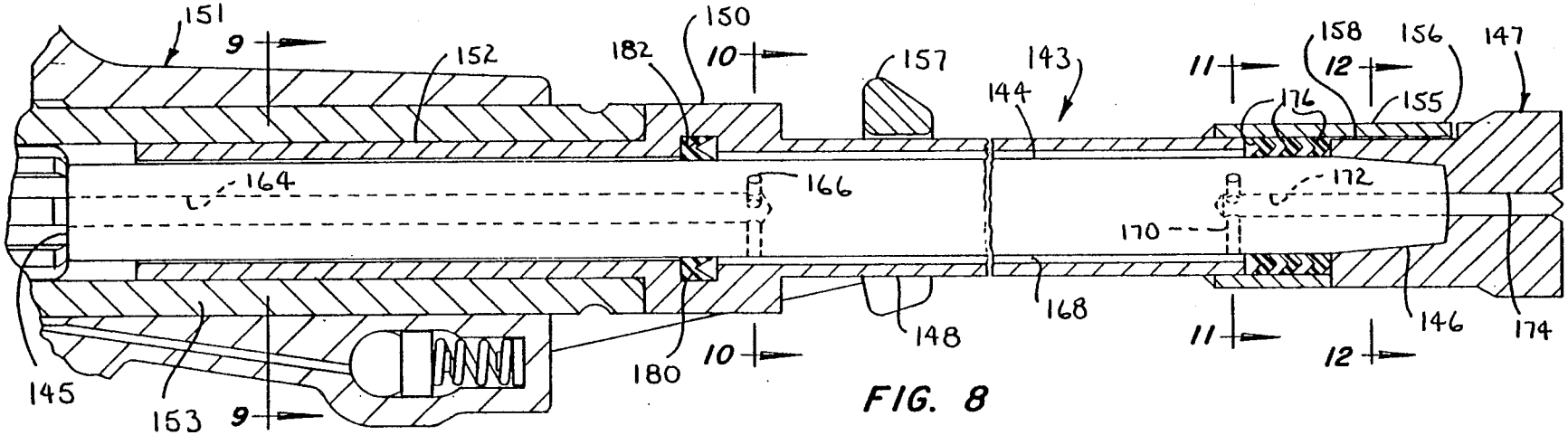
FIG. 8 is a longitudinal section view of an integral or one piece percussion drill rod assembly in accordance with the present invention.
Figure 11:
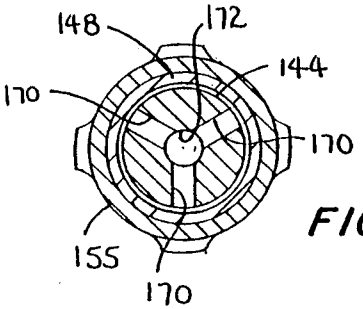
FIG. 11 is a section view taken along the line 11—11 of FIG. 8.
Figure 12:
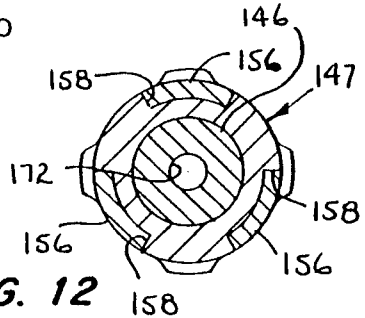
FIG. 12 is a section view taken along the line 12—12 of FIG. 8.
Figure 7:
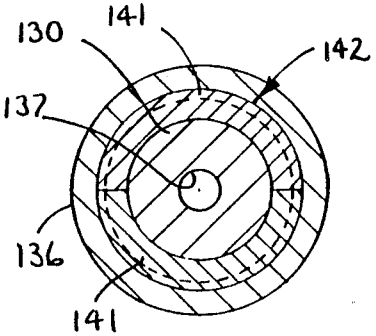
FIG. 7 is a section view taken along the line 7—7 of FIG. 6.

Referring now to FIG. 6 there is illustrated a modification of a bit end adapter assembly for use with concentric drill rod assemblies such as the assembly of the drill rod 18 and the tubular coupling number 20. The adapter assembly illustrated in FIG. 6 includes a bit adapter member 130 of generally cylindrical configuration and having suitable threads 132 formed thereon for coupling to a conventional internally threaded rock bit 133. The adapter 130 includes longitudinal splines 132 formed thereon which are cooperable with splines 134 formed on a generally tubular coupling member 136. The coupling member 136 is provided with suitable threads 138 for connecting the coupling member to a tubular torque transmitting member 139 similar to the member 20 illustrated in FIGS. 1A and 1B. The coupling member 136 is also provided with threads 140 at its opposite end for receiving a cylindrical threaded bushing 142 which is split longitudinally into opposed bushing half portions 144 and 146 as shown also in FIG. 7. The threaded bushing 142 is provided to secure the adapter 130 and the coupling 136 in assembly with each other and to prevent displacement of the adapter from interfitting engagement of the splines 135 and 134. The adapter 130 is provided with an impact blow receiving surface 131 for engagement with a cooperating surface on a percussion drill rod such as the rod member 18. Chip evacuation fluid is conducted through the adapter 130 by way of a passage 137 to suitable passages formed in a bit, not shown, when coupled to the adapter 130. The configuration of the adapter 130 minimizes the abrupt change in diameter required also of the adapter 72 which, as stated hereinabove, reduces the energy losses from reflection of percussive blow energy.

Figure 9:
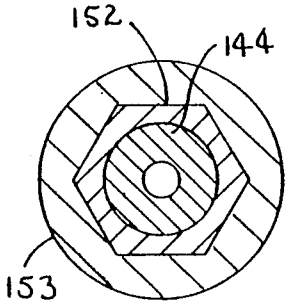
FIG. 9 is a section view taken along the line 9—9 of FIG. 8.

Referring now to FIGS. 8 through 12, in some applications of percussions drills it is desirable to provide the percussion drill rod assembly as a so-called integral or one piece member, particularly in applications of so-called handheld drills such as feed leg, stoper or sinker drills. An improved drill rod assembly 143 in accordance with the present invention is illustrated and includes a substantially constant diameter inner percussion rod member 144 having an impact blow receiving surface 145 at one end and a tapered portion 146 at its opposite end for direct connection to a percussion bit 147. The rod member 144 is journaled within an elongated tubular coupling member 148 having an integral collar portion 150 for retention in the chuck end of a drill motor 151 by retainer means 157. The end of the coupling member 148 adjacent to the impact receiving end of the rod member 144 is formed with a polygonal drive portion 152 as shown in FIG. 9 also for driving engagement with a drill chuck 153. The opposite end of the substantially tubular coupling member 148 is formed with an integral collar 155 having a plurality of axially extending drive fingers 156, see FIGS. 11 and 12 also, which extend into cooperating keyways 158 formed in the bit 147 for transmitting rotary driving torque to the bit directly through the coupling member and not through the percussion rod member itself.

Figure 10:
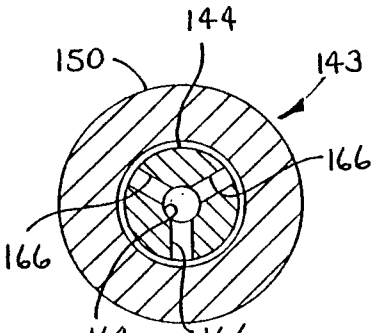
FIG. 10 is a section view taken along the line 10—10 of FIG. 8.

Drill cuttings evacuation fluid may be transmitted through the drill rod assembly illustrated in FIGS. 8 through 12 by way of a passage 164 formed in the impact receiving end of the rod member 144, which passage is in communication with radially extending passages 166, see FIG. 10, which open into an annual space 168 formed between the rod member 144 and the tubular coupling member 148. The opposite end of the rod member 144 is provided with further radially extending passages 170 which are in communication with an axial passage 172 opening into a passage 174 in the bit 147. Resilient annular seals 176 are provided between the rod member 140 and the cylindrical collar portion 155 of the coupling member 148. An annular seal 180 is disposed in a seal receiving groove 182 formed in the collar portion 150 to minimize the leakage of drill cuttings evacuation fluid from the passage 168. The seals 176 and 180 also assist in journaling the rod member 140 with respect to the tubular coupling member 148 to minimize the transmission of sound to the environment around the drill rod assembly.

With the arrangement of the integral drill rod assembly illustrated in FIGS. 8 through 12, impact blow energy alone is transmitted through the elongated substantially constant diameter rod 144 while rotational torque only is transmitted through the tubular coupling member 148. The drill rod assembly illustrated in FIGS. 8 through 12 enjoys all of the advantages of the concentric drill rod assembly illustrated in FIGS. 1A and 1B in that the inner rod member transmits only percussion blows and is configured to minimize the loss of percussion blow energy as a result of no change in cross-section of the rod or change in its outside diameter. The inner rod member 144 is protected from abrasion, is not required to transmit rotational torque throughout its length and the transmission of noise from vibration of the inner rod is minimized by the enveloping tubular coupling member 148.

Figure 13:
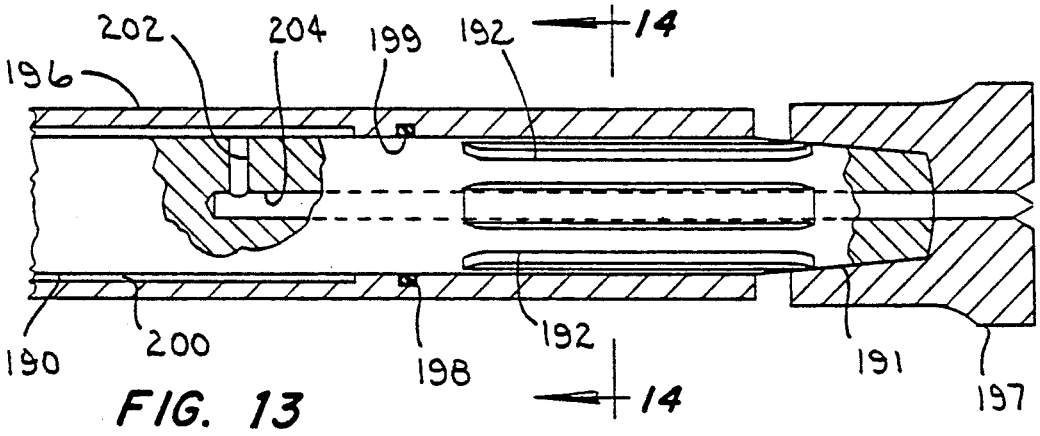
FIG. 13 is a view of a modification of the bit end of an integral or handheld drill rod assembly.
Figure 14:
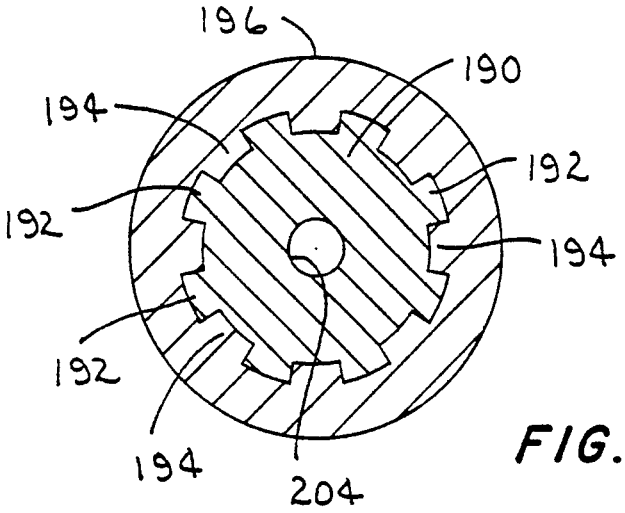
FIG. 14 is a section view taken along line 14—14 of FIG. 13.

Referring now to FIGS. 13 and 14, there is illustrated a modification of the integral drill rod assembly of the type illustrated in FIGS. 8 through 12 wherein an inner rod member 190 similar to the rod member 144, is provided and has at its bit connection end longitudinal splines 192 formed thereon which are cooperable with interfitting splines 194 formed on a modified tubular coupling member 196. The rod member 190 is provided with a tapered end portion 191 which is secured to a bit 197 similar to the bit 147 but not required to have the longitudinal keyways formed therein for driving connection with the tubular coupling member. The opposite end of the integral drill rod assembly comprising the rod member 190 and the tubular coupling member 196 may be similar to the arrangement illustrated in FIG. 8. A resilient annular seal member 198 is disposed in a groove 199 and journals the rod member 190 relative to the member 196. Cuttings evacuation fluid may be conducted to the bit 197 through annular passage 200 and passages 202 and 204 formed in the rod member 190. Accordingly, as with the arrangement illustrated in FIGS. 8 through 12, the integral drill rod assembly shown in FIG. 13 also has an inner percussion blow transmitting rod member which, throughout a majority of its length is adapted to transmit percussion blows only, is of substantially constant diameter throughout its length but is adapted to be used with conventional unmodified rock bits since rotary torque is transmitted to the rock bit only through the very end part of the rod member 190 adjacent to the bit 197 as provided by the tubular coupling member 196.

Although preferred embodiments of concentric drill rod assemblies have been described herein in detail those skilled in the art will recognize that various substitutions and modifications may be made to the specific configurations shown without departing from the scope and spirit of the invention as recited in the appended claims.

What is claimed is:

1. A drill rod assembly for transmitting percussion impact blows and rotation to a rock penetrating bit, said drill rod assembly comprising:

an elongated substantially cylindrical rod member of substantially constant diameter having an impact blow receiving surface at one end and means at its opposite end for connecting said rod member to said bit; and an elongated tubular coupling member disposed in sleeved relationship around said rod member, said coupling member having means at one end for driveably connecting said coupling member to means for rotating said drill rod assembly, means on said coupling member for retaining said drill rod assembly in driving engagement with a drill motor and means at the opposite end of said coupling member for imparting rotation to said bit without imposing torque on said rod member throughout at least a major portion of the length of said rod member comprising cooperating splines formed on said coupling member and said rod member at the respective ends of said coupling member and said rod member adjacent to said bit.

2. An integral drill rod assembly for transmitting percussion impact blows and rotation to a rock penetrating bit, said drill rod assembly comprising:

an elongated substantially cylindrical rod member of substantially constant diameter having an impact blow receiving surface at one end and means at its opposite end for connecting said rod member to said bit; and an elongated tubular coupling member disposed in sleeved relationship around said rod member, said coupling member having means at one end for driveably connecting said coupling member to means for rotating said drill rod assembly and means at the opposite end of said coupling member for imparting rotation to said bit without imposing torque on said rod member throughout at least a major portion of the length of said rod member comprising cooperating splines formed on said coupling member and said rod member at respective ends of said coupling member and said rod member adjacent to said bit, and spaced apart resilient means interposed between said rod member and said coupling member for journaling said rod member relative to said coupling member.

3. A percussion drill rod assembly for transmitting impact blows and rotary motion from a drill motor to a rock bit comprising:

an inner elongated cylindrical percussion blow transmitting rod member having opposed transverse surfaces at its opposite ends for engagement with impact blow transmitting means, said rod member having an outer surface of substantially constant diameter throughout its length;

an elongated tubular coupling member disposed around said rod member, said coupling member having means at its opposite ends for connection to rotational torque transmitting means, said tubular coupling member including means for journaling said rod member within said tubular coupling member comprising a plurality of resilient isolator members supported by said tubular coupling member and spaced apart one from the other and engaged with said outer surface for isolating said rod member from direct contact with said tubular coupling member to minimize the transmission of sound from said rod member to the environment surrounding said drill rod assembly;

a shank assembly including means for transmitting rotational torque to said tubular coupling member and means for transmitting impact blows to said rod member; and adapter means coupled to said tubular coupling member and said rod member for transmitting rotational torque and impact blow energy to a rock penetrating bit member, said adapter means including an adapter member having means thereon for connecting said adapter member to a percussion it and an impact blow receiving surface on said adapter member for engagement with said rod member;

a coupling member disposed in sleeved relationship over said adapter member and including coupling means for connecting said coupling member to said tubular coupling member and means on said coupling member and said adapter member for rotary driving engagement of said coupling member with said adapter member; and means for releasably connecting said coupling member to said adapter member comprising a threaded retaining member threadedly engageable with said coupling member, said retaining member comprising a generally cylindrical part which is axially split into at least two half members for assembly and disassembly with respect to said coupling member and said adapter member for retention of said coupling member and said adapter member in assembly with each other and for transmitting rotational torque and impact blows through said adapter member to said bit.

* * * * *